US010982688B2

(12) United States Patent
Hoyt et al.

(10) Patent No.: US 10,982,688 B2
(45) Date of Patent: Apr. 20, 2021

(54) HVAC FAN ASSEMBLY AIR INLET SYSTEMS AND METHODS

(71) Applicant: Johnson Controls Technology Company, Auburn Hills, MI (US)

(72) Inventors: Bennie D. Hoyt, Renton, KS (US); Paul Lucas, Wichita, KS (US); Brian D. Rigg, Douglass, KS (US); Elton D. Ray, Wichita, KS (US); Joshua O. Loyd, Wichita, KS (US)

(73) Assignee: Johnson Controls Technology Company, Auburn Hills, MI (US)

( * ) Notice: Subject to any disclaimer, the term of this patent is extended or adjusted under 35 U.S.C. 154(b) by 65 days.

(21) Appl. No.: 16/288,971

(22) Filed: Feb. 28, 2019

(65) Prior Publication Data

US 2020/0240433 A1 Jul. 30, 2020

Related U.S. Application Data

(60) Provisional application No. 62/797,652, filed on Jan. 28, 2019.

(51) Int. Cl.

| | |
|---|---|
| ***F04D 29/44*** | (2006.01) |
| ***F04D 17/16*** | (2006.01) |
| ***F24F 7/06*** | (2006.01) |

(52) U.S. Cl.

CPC ..... *F04D 29/441* (2013.01); *F04D 17/16* (2013.01); *F24F 7/065* (2013.01)

(58) Field of Classification Search

CPC ..... F04D 29/441; F04D 17/16; F24F 7/065
USPC ..... 62/426
See application file for complete search history.

(56) References Cited

U.S. PATENT DOCUMENTS

| | | | | |
|---|---|---|---|---|
| 7,461,518 | B2 | 12/2008 | Higashida | |
| 8,177,484 | B2 | 5/2012 | Haraguchi et al. | |
| 2006/0093499 | A1* | 5/2006 | Horng | F04D 25/0613 417/423.1 |
| 2015/0369514 | A1* | 12/2015 | Groskreutz | F24F 13/24 62/296 |
| 2017/0130723 | A1* | 5/2017 | Kosaka | F04D 29/4213 |
| 2017/0261000 | A1 | 9/2017 | Komura et al. | |

FOREIGN PATENT DOCUMENTS

| | | | | |
|---|---|---|---|---|
| CN | 100380000 C | | 4/2008 | |
| CN | 104763684 B | | 7/2015 | |
| CN | 205446190 U | | 8/2016 | |
| JP | 2013057298 A | * | 3/2013 | F04D 29/162 |
| KR | 20050048159 A | | 5/2005 | |

* cited by examiner

*Primary Examiner* — Steve S Tanenbaum
(74) *Attorney, Agent, or Firm* — Fletcher Yoder, P.C.

(57) ABSTRACT

The present disclosure describes techniques concerning a fan assembly. The fan assembly may include a fan, having multiple blades to rotate about an axis, and a housing in which the fan is disposed. Additionally, the fan assembly may include an air inlet formed in a wall of the housing that is transverse to the axis. The air inlet may define an orifice and includes multiple air guides that each extend into the housing from a perimeter of the air inlet.

26 Claims, 7 Drawing Sheets

HVAC FAN ASSEMBLY AIR INLET SYSTEMS AND METHODS

CROSS-REFERENCE TO RELATED APPLICATIONS

This application claims priority from and the benefit of U.S. Provisional Application No. 62/797,652, filed Jan. 28, 2019, entitled "HVAC FAN ASSEMBLY AIR INLET SYSTEMS AND METHODS," which is incorporated herein by reference in its entirety.

BACKGROUND

The present disclosure generally relates to heating, ventilation, and/or air conditioning (HVAC) systems and, more particularly, to an air inlet of a blower fan deployed in an HVAC system.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

A heating, ventilation, and/or air conditioning (HVAC) system is often deployed in a building to facilitate controlling air conditions, such as temperature and/or humidity, within the building. For example, an HVAC system may include equipment, such as one or more heat exchangers deployed in an HVAC unit, which operates to produce temperature-controlled air. To facilitate supplying the temperature-controlled air to a conditioned space, the HVAC system may include one or more fans assemblies, for example, deployed in the HVAC unit.

Generally, a fan assembly may include a housing and one or more fan blades disposed in the housing. In other words, actuation of the one or more fan blades may draw air into the fan assembly via an air inlet formed in the housing and/or expel air out from the fan assembly via an air outlet formed in the housing. However, at least in some instances, geometry of its air inlet may affect air flow through a fan assembly. In fact, in some instances, the geometry of the air inlet may produce turbulence in air flow through the fan assembly, which increases noise produced by operation of the fan assembly and/or decreases operational efficiency of the fan assembly.

SUMMARY

This section provides a brief summary of certain embodiments described in the present disclosure to facilitate a better understanding of the present disclosure. Accordingly, it should be understood that this section should be read in this light and not to limit the scope of the present disclosure. Indeed, the present disclosure may encompass a variety of aspects not summarized in this section.

The present disclosure relates to a fan assembly that may include a fan, having multiple blades to rotate about an axis, and a housing in which the fan is disposed. Additionally, the fan assembly may include an air inlet formed in a wall of the housing that is transverse to the axis. The air inlet may define an orifice and includes multiple air guides that each extend into the housing from a perimeter of the air inlet.

The present disclosure also relates to a fan housing that may include a body to house fan blades, an air inlet to facilitate an air flow into the body and to the fan blades, and an air outlet to facilitate the air flow away from the fan blades and out of the body. The body may also include multiple air guides disposed on the body about the air inlet, the air outlet, or both. Each of the guides may be a tooth-shaped protrusion oriented to point in a direction of the air flow.

The present disclosure also relates to a heating, ventilation, and air conditioning (HVAC) system including ductwork to transport an air flow and a centrifugal blower assembly. The blower assembly may have a housing, a motor, and a plurality of blades forming a cage within the housing, wherein the motor is may rotate the cage to draw the air flow through an air inlet of the housing and force the air flow out an air outlet of the housing. Additionally, the air inlet may include multiple tooth-shaped air guides disposed about the perimeter of the air inlet and extending toward the blades to reduce the generation of eddies within the housing.

BRIEF DESCRIPTION OF THE DRAWINGS

Various aspects of the present disclosure may be better understood upon reading the detailed description and upon reference to the drawings, in which.

DETAILED DESCRIPTION

Figure 1:
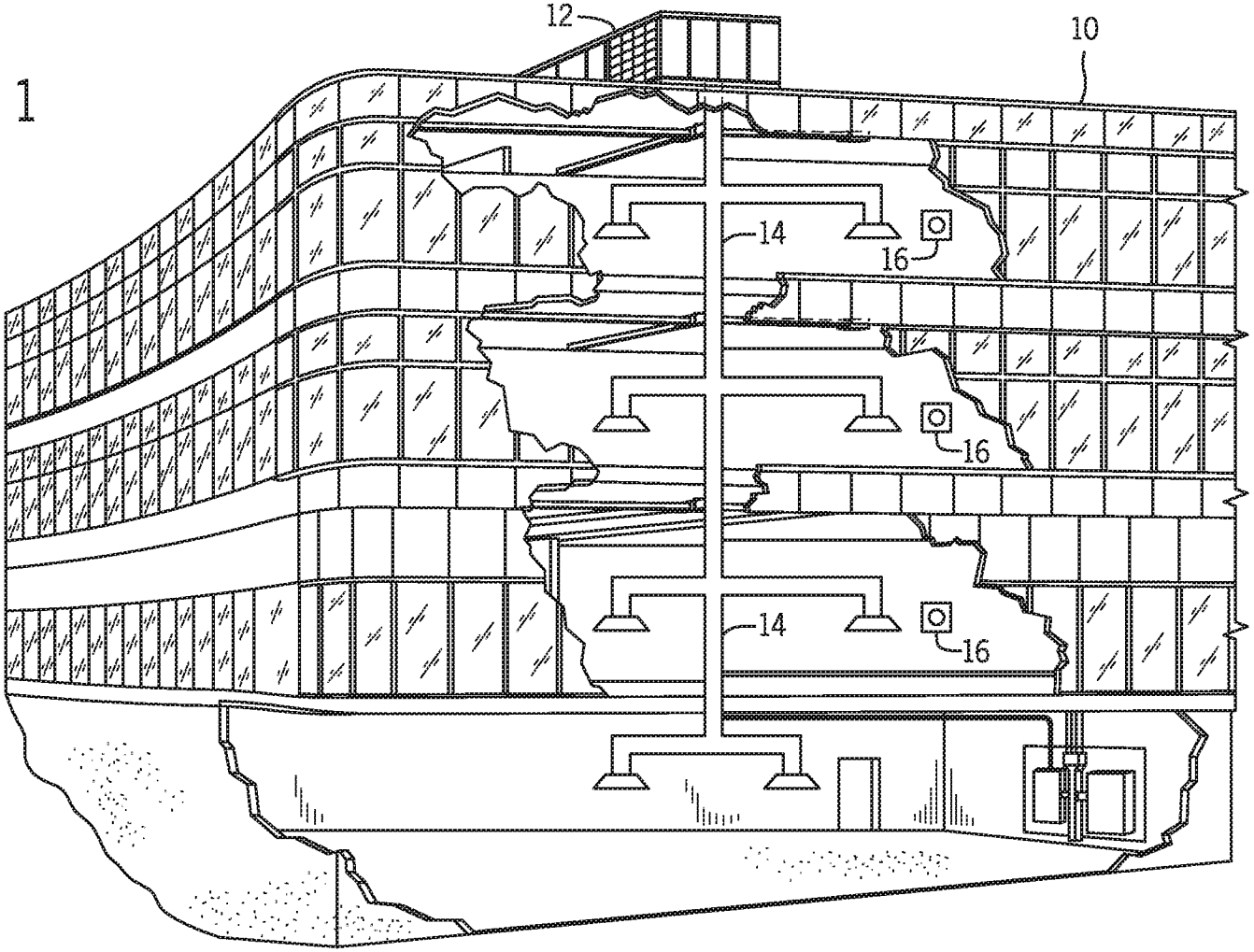
FIG. 1 is a partial cross-sectional view of a building that includes a heating, ventilating, and air conditioning (HVAC) system, in accordance with an embodiment of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As will be discussed in further detail below, a heating, ventilation, and/or air conditioning (HVAC) system, such as air conditioners and/or heat pumps, generally includes one or more fan assemblies, such as an axial fans and/or a centrifugal fans to facilitate producing temperature-controlled air and/or to facilitate supplying the temperature-controlled air to a condition space. For example, a fan assembly may be operated to move over air over heat exchanger coils, such as condenser coils or evaporator coils, to facilitate producing temperature-controlled air. Additionally or alternatively, a fan assembly may be operated to facilitate supplying the temperature-controlled air to a conditioned space, for example, via ductwork fluidly coupled between the heat exchanger coils and the conditioned space.

To facilitate moving air, a fan assembly generally include one or more fan blades, which may be coupled to and thus, driven by a motor. Additionally, to facilitate guiding airflow, the fan blades may be disposed in a housing or shroud, which includes an air inlet and an air outlet. Generally, actuation of fan blades may produce a negative pressure region. In other words, during operation of a fan assembly, its motor may actuate fan blades coupled thereto to draw air into the fan assembly via the air inlet and/or expel air from the fan assembly via the air outlet.

However, at least in some instances, operation of a fan assembly generally produces some amount of turbulence in the air flow from its air inlet to its air outlet. For example, in a centrifugal blower assembly, an air inlet may be orthogonal or otherwise non-parallel to its air outlet and, thus, turbulence may result in air flow through its housing due at least in part to the air flow being forced to abruptly change direction. In fact, at least in some instances, the amount of turbulence produced in a fan assembly may affect its operational efficiency and/or operating noise, for example, due to more turbulence increasing noise and/or reducing throughput, such as a flow rate, produced by operation of the fan assembly.

Accordingly, to facilitate improving operational efficiency and/or reducing operating noise, the present disclosure provides techniques for implanting a fan assembly with an air inlet geometry that facilitate reducing turbulence produced in the fan assembly during operation. To facilitate reducing turbulence, in some embodiments, an air inlet of a fan assembly may be implemented with one or more air guides formed along a perimeter of the air inlet. As will be described in more detail below, an air guide may include solid material that extends from a housing of the fan assembly into an orifice or opening of the air inlet. For example, the air guide may be formed in the shape of a "shark tooth." In fact, in some embodiments, an air guide may be curved, for example, such that the air guide is non-planar with the opening of the air inlet and/or its tip points toward an internal portion of the fan assembly.

In some embodiments, one or more air guides may be integrated with a housing of a fan assembly, for example, such that the one or more air guides are implemented using the same material as the housing. Thus, in such embodiments, an air inlet of the fan assembly may implemented at least in part by forming an opening with one or more air guides along its perimeter in the housing. Additionally or alternatively, an air guide may be a discrete component and, thus, may be coupled to the housing at a position along the perimeter of an air inlet.

In any case, implementing a fan assembly with an air inlet that includes one or more air guides may change geometry of an opening of the air inlet. In particular, one or more air guides may interact with air being drawn through an opening of the air inlet and, thus, affects flow pattern of air resulting in the fan assembly. In fact, in some embodiments, the one or more air guides may facilitate smoothing air flow through the fan assembly and, thus, reducing magnitude of turbulence produced in the fan assembly, for example, as well as reducing magnitude and/or likelihood of cavitation occurring in the fan assembly.

In this manner, as will be described in more detail below, one or more air guides may be disposed in the path of the air flow to change the geometry of the air inlet of the housing to decrease noise associated with the funneling of air into the housing and/or to increase the efficiency of the air flow by decreasing the generation of eddies and turbulence. Additionally, the increased efficiency may decrease the load on the motor, allowing for decreased electrical draw, increased air flow, or both. As will be discussed in detail below, the air guides may be formed into or affixed to the housing of a fan assembly approximate an opening of the air inlet. Moreover, although generally described herein as applying to the air inlet of the housing of a centrifugal blower, the air guides may be implemented around any suitable orifice and/or on the air inlet or air outlet to any suitable fan assembly, such as around the perimeter of a shroud of an axial fan, or the air inlet of a centrifugal blower.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
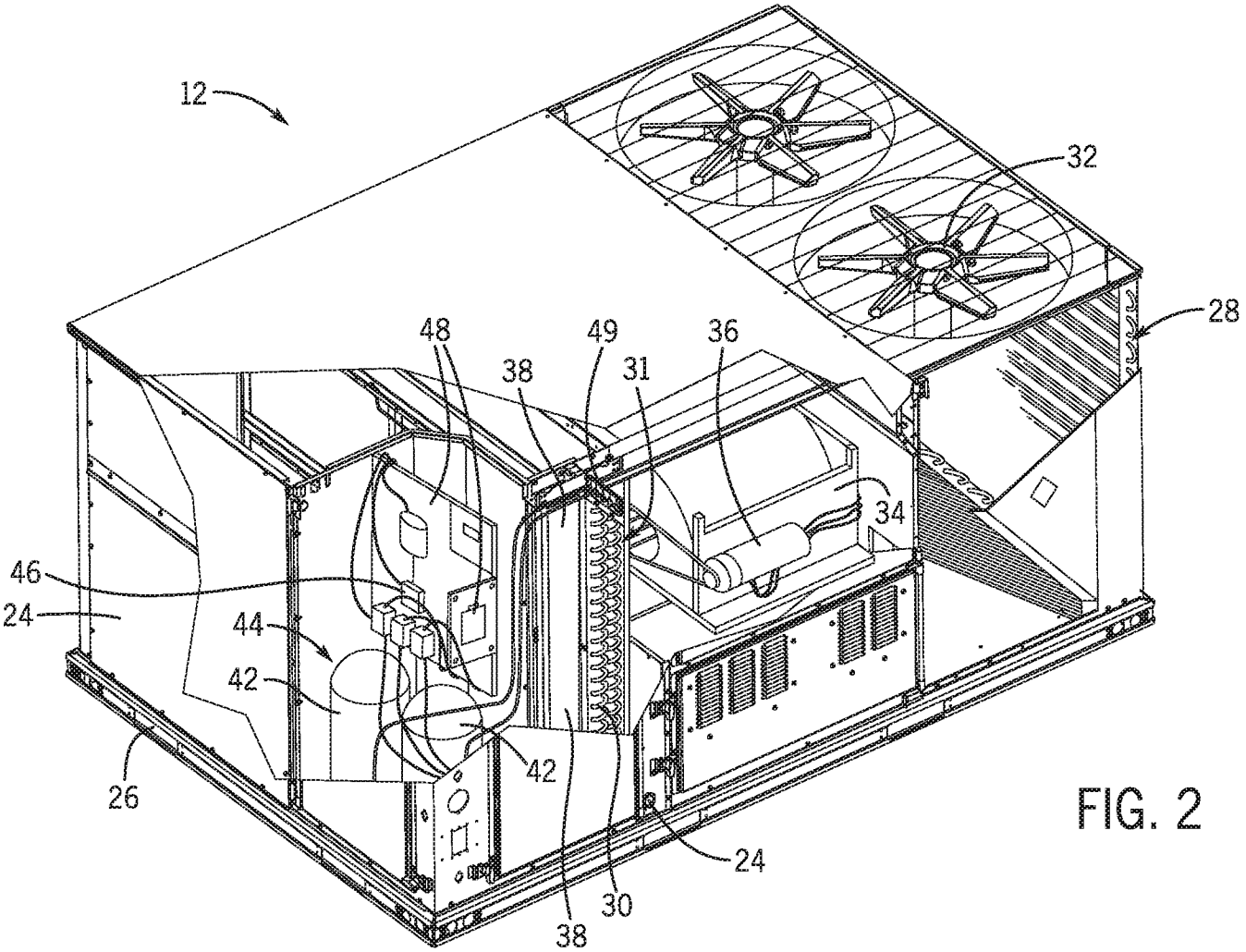
FIG. 2 is a partial cross-sectional view of an HVAC unit that may be included in the HVAC system of FIG. 1, in accordance with an embodiment of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
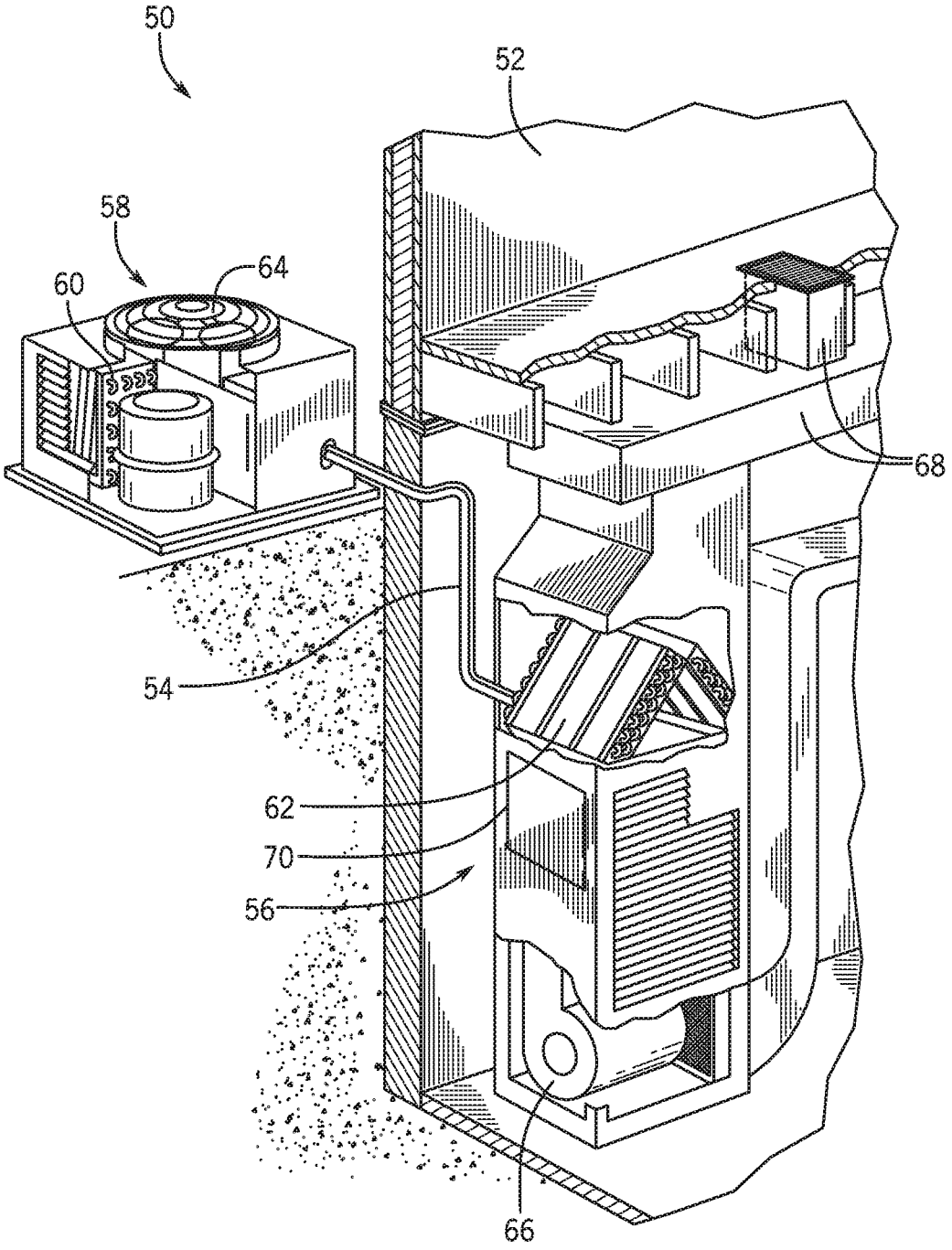
FIG. 3 is a partial cross-sectional view of an outdoor HVAC unit and an indoor HVAC unit that may be included in the HVAC system of FIG. 1, in accordance with an embodiment of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit 56 functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or a set point plus a small amount, the residential heating and cooling system 50 may become operative to refrigerate additional air for circulation through the residence 52. When the temperature reaches the set point, or a set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace system 70 where it is mixed with air and combusted to form combustion products. The combustion products may pass through tubes or piping in a heat exchanger, separate from heat exchanger 62, such that air directed by the blower or fan 66 passes over the tubes or pipes and extracts heat from the combustion products. The heated air may then be routed from the furnace system 70 to the ductwork 68 for heating the residence 52.

Figure 4:
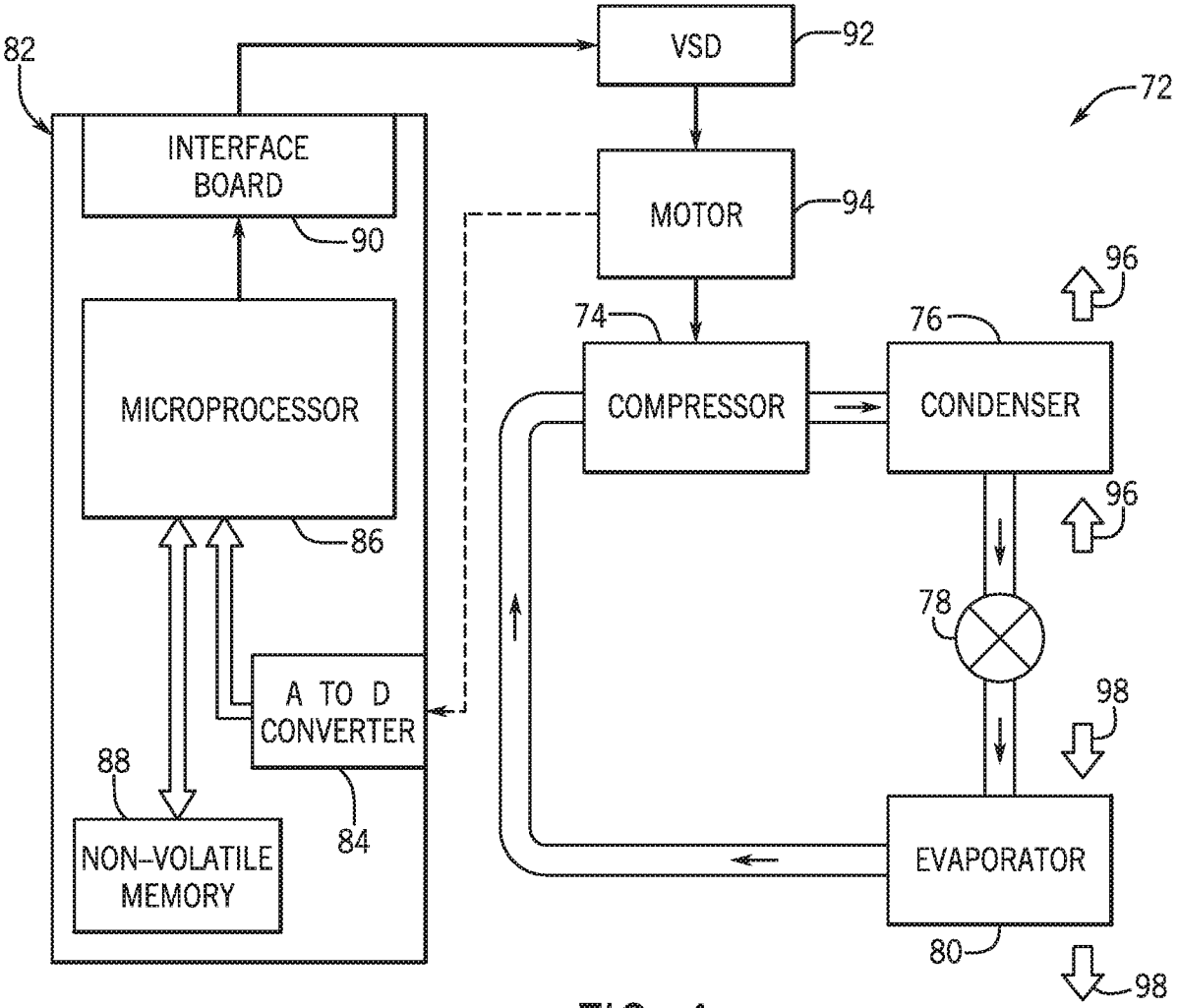
FIG. 4 is a schematic diagram of a refrigerant loop that may be implemented in the HVAC system of FIG. 1, in accordance with an embodiment of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As described above, an HVAC system may include a fan assembly, such as a fan 32 or blower assembly 34. Generally, a fan assembly may be operated to move air through the HVAC system and/or a space serviced by the HVAC system. For example, a first fan assembly may operate to move the environmental air 96 around one or more heat exchanger coils deployed in a condenser 76 to extract heat from refrigerant flowing through the condenser 76 and, thus, producing heated air. On the other hand, a second fan assembly may operate to move the supply air stream 98 that passes around one or more heat exchanger coils deployed in the evaporator 80, thereby using refrigerant flowing through the evaporator 80 to extract heat from the supply air stream 98 and, thus, producing cooled air. Additionally or alternatively, a fan assembly may operate to flow air through the ductwork 14, for example, to facilitate supplying conditioned air to a space serviced by the HVAC system.

Figure 5:
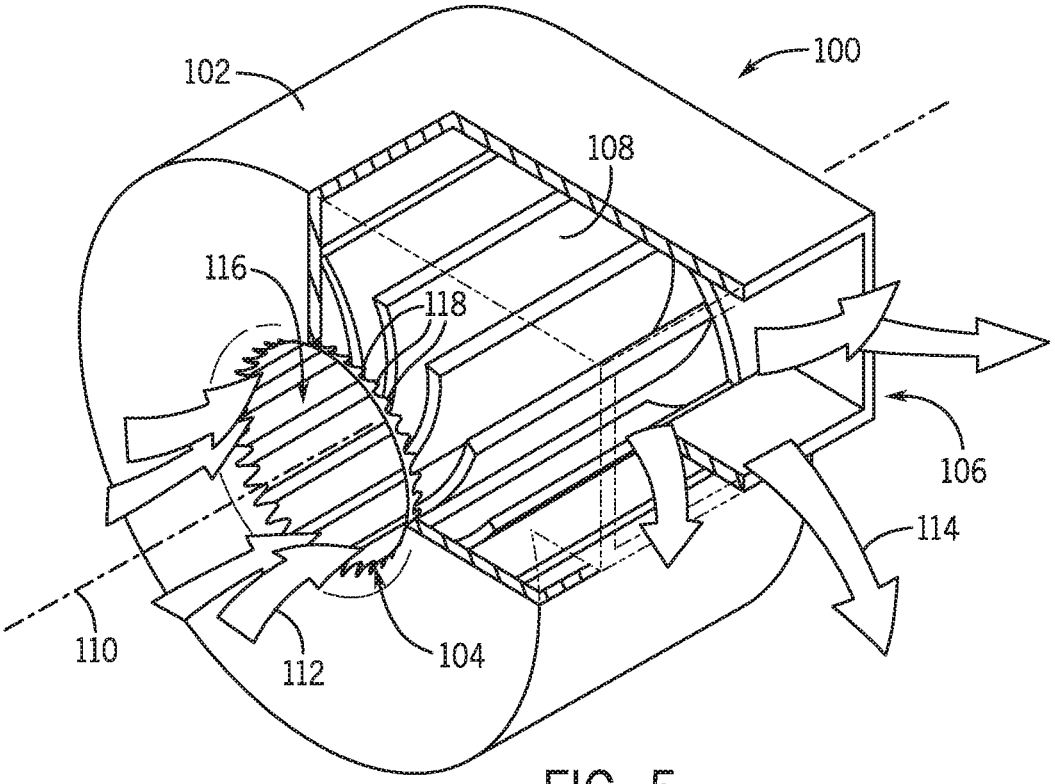
FIG. 5 is a perspective view of an example of an fan assembly with multiple air guides at its air inlet, in accordance with an embodiment of the present disclosure.

To help illustrate, an example of a fan assembly 100, such as a fan 32 or a blower assembly 34, is shown in FIG. 5. As in the depicted example, the fan assembly 100 may be a centrifugal blower assembly. However, it should be appreciated that the depicted example is merely intended to be illustrative and not limiting. In particular, it should be appreciated that the techniques described in the present disclosure may be applied to other types of fan assemblies, such as an axial fan assembly.

Generally, as in the depicted example, a fan assembly 100 may include a housing 102, an air inlet 104, an air outlet 106, and fan blades 108 disposed within the housing 102. In some embodiments, the air inlet 104 and/or the air outlet 106 may be integrally formed with the housing 102, for example, by removing and/or shaping housing material. In other embodiments, the air inlet 104 and/or the air outlet 106 may be a discrete component coupled to an opening formed in the housing 102. Additionally, as will be described in more detail below, in some embodiments, the fan assembly 100 may include multiple air inlets 104 and/or multiple air outlets 106.

Although not depicted in FIG. 5, as described above, a fan motor may be mechanically connected to the fan blades 108, for example, via a shaft extending along a central axis 110 of the fan blades 108. Additionally, in some embodiments, the fan motor may be deployed, at least partially, within the housing 102, for example, radially adjacent to the fan blades 108. In other embodiments, the fan motor may be deployed, at least partially, external from the housing 102, for example, such that the fan motor is affixed to an exterior surface of the housing 102 and coupled to the fan blades 108 via a shaft, a belt, and/or one or more pulleys.

In this manner, one or more fan blades 108 of a fan assembly 100 may be actuated during operation of the fan assembly 100. In particular, actuation of the fan blades 108 may produce a low pressure region within the housing 102, such as within a cage of the fan blades 108, thereby drawing in an incoming air flow 112 into the fan assembly 100 via the air inlet 104. Additionally, actuation of the fan blades 108 may produce a high pressure region between the blades 108 and the housing 102, for example, due to the incoming air flow 112 being slung against an interior surface of the housing 102, thereby expelling an outbound air flow 114 via an air outlet 106.

However, at least in some instances, operation of a fan assembly 100 may produce turbulence, which affects operational efficiency and/or operating noise of the fan assembly 100 and, thus, an HVAC system in which the fan assembly 100 is deployed. Generally, turbulence may result when an air flow is forced to abruptly change directions. Thus, in some embodiments, turbulence may be produced in a fan assembly 100 at least in part due to the fan assembly 100 operating to mix multiple different air streams, for example, received via multiple air inlets 104, each fluidly coupled to a different air source and, thus, potentially having different temperatures. Additionally or alternatively, turbulence may be produced during operation of a fan assembly 100 due at least in part to the air inlet 104 and the air outlet 106 of the fan assembly 100 being oriented in different directions. Moreover, turbulence may be produced as the incoming air flow 112 enters an orifice 116 of the housing 102 through the air inlet 104. For example, as the incoming air flow 112 funnels into the housing 102 past the air inlet 104, eddies and/or other air instabilities may form at the edge of the air inlet 104 as the incoming air flow 112 attempts to adhere to the surface of the air inlet 104 and/or housing 102.

In other words, at least in such instances, operation of the fan assembly 100 may produce a turbulent air flow therethrough. Generally, a turbulent air flow includes eddies, vortices, and/or other flow instabilities that may take away from the energy of the air flow. Moreover, at least in some instances, a turbulent air flow may cause cavitation in a fan assembly 100. As such, increased turbulence in a fan assembly 100 may reduce throughput or flow rate produced by operation of the fan assembly 100 and, thus in fact, may result in more electrical power being supplied to its fan motor to achieve a target throughput or flow rate. Moreover, noise resulting from operation of a fan assembly 100 generally increases as turbulence in the fan assembly 100 increases.

To facilitate reducing turbulence produced in a fan assembly 100, as in the depicted example, one or more air guides 118 may be implemented around the orifice 116 of an air inlet 104, for example, along at least portion of the perimeter of the air inlet 104 and/or along the circumference of the air inlet 104 around the circumference of the orifice 116. In particular, as in the depicted example, an air guide 118 may extend from the housing 102 into the orifice 116 of the air inlet 104, thereby affecting geometry of the orifice 116 and, thus, the intake flow pattern of the incoming air flow 112 drawn into the fan assembly 100 via the air inlet 104. In addition to having laminar and/or turbulent flow properties, the incoming air flow 112 may include a boundary layer of air along the outer surface of the housing 102 and/or the air inlet 104 as the air moves along the surface of the housing 102, through the air inlet 104, and into the fan assembly 34.

Due to the boundary layer, the incoming air flow 112 may have a tendency to adhere to the surface of the housing 102 and/or the air inlet 104, preventing a smooth transition into the interior of the fan assembly 34. The attempt at adherence to the surface of the air inlet 104 may cause turbulence within the incoming air flow 112 during flow separation of the incoming air flow 112 from the surface of the air inlet 104. For example, as the boundary layer of the incoming air flow 112 separates from the air inlet a portion of the incoming air flow 112 may circle back to and/or be slowed significantly by the trailing edge, relative to the direction of flow, of the air inlet 104, and, thus, generate eddies and/or cavitation inside the housing 102 near the air inlet 104 inside the housing 102. The air guides 118, however, may allow for a smoother separation of the boundary layer from the surface of the air inlet 104, the housing 102, and, therefore, cause a reduction in the generation of turbulence.

Figure 6:
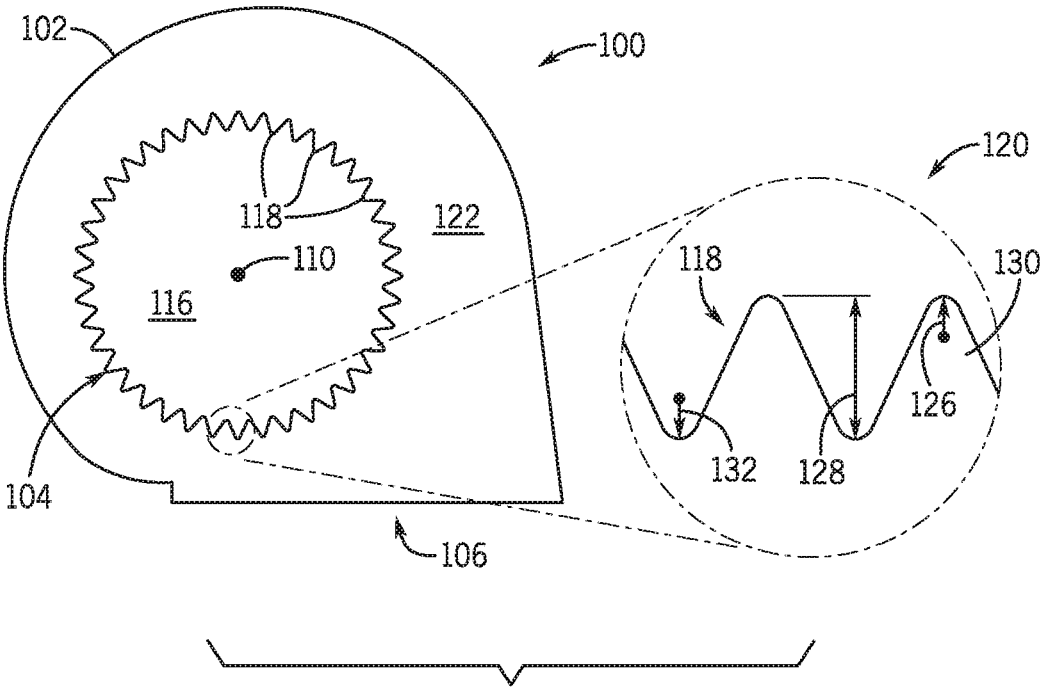
FIG. 6 is a side view of the example fan assembly of FIG. 5 with a magnified view of the air inlet, in accordance with an embodiment of the present disclosure.

To help further illustrate, an example fan assembly 100 including an air inlet 104 with air guides 118 implemented along its perimeter, and a more detailed view 120 of an example air guide 118 are shown in FIG. 6. As in the depicted example, in some embodiments, an air guide 118 may be implemented with a "shark tooth" shape that extends from the housing 102 into the orifice 116 of the air inlet 104. However, it should be appreciated that the depicted example is merely intended to be illustrative and not limiting. In particular, in other embodiments, one or more of the air guides 118 along the perimeter of an air inlet 104 may be implemented with different shapes. For example, an air guide 118 may be implemented with a circular shape, semi-circular shape, or a polygonal shape such as a triangle, rectangle, or trapezoid.

Additionally, as in the depicted example, the air guides 118 may be implemented to point toward, at least partly, the central axis 110. In some embodiments, one or more of the air guides 118 may extend from the air inlet 104 coplanar and/or parallel to the orifice 116 of the air inlet 104 and/or to a sidewall 122 of the housing 102. The sidewall 122, in some embodiments, may be situated transverse and/or approximately perpendicular to the axis 100 and/or the incoming air flow 112. Additionally or alternatively, one or more of the air guides 118 may be angled or curved relative to the orifice 116 of the air inlet 104 and/or to the sidewall 122 of the housing 102. For example, an air guide 118 may be angled five degrees, ten degrees, fifteen degrees, thirty degrees, forty-five degrees, sixty degrees, ninety degrees, or more relative to a plane of the sidewall 122. Additionally or alternatively, an air guide 118 may be filleted such that the air guide 118 curves toward an interior region of a fan assembly and, thus, angle of the air guide 118 relative to the plane of the sidewall 122 may vary over the length of the air guide. In some embodiments, angled or curved air guides 118 and/or air guides 118 disposed on a fillet 124, such as in FIG. 7, may assist in funneling the incoming air flow 112 into the fan assembly 100 and/or allow for increased efficiency of the fan blades 108, for example, by reducing cavitation.

Furthermore, different sized air guides 118 may be used depending on implementation, such as different sized fan assemblies 100 and/or different velocities of air flows. For example, returning to FIG. 6, the air guides 118 may have a relatively small point radius 126, such as 0.01, inches, 0.05 inches, or 0.25 inches, compared to a length 128 of the protrusion 130 of the air guide 118, such as 0.5 inches, 0.625 inches, less than or equal to 1.0 inch, or greater than 1 inch, with a ratio of length 128 to point radius 126 greater than or equal to 1, such as greater than or equal to 5 or greater than or equal to 12.5. Moreover, the air guides 118 may have a trough radius 132 greater than or equal to the point radius 126. For example, the trough radius 132 may be 0.05 inches, 0.1 inches, or 0.25 inches. As will be appreciated, the size and/or shape of the air guides 118 may depend on implementation, such as the size of the fan assembly 34 and air inlet 104. Additionally or alternatively, the size of the air guides 118 may correspond to the velocity of the incoming air flow 112 such that the flow separation from the edge of the air inlet 104 is smoother relative to without the air guides 118. body In some embodiments, the air guides 118 may be integrated into the sidewall 122 of the housing 102 or implemented separately and affixed to the sidewall 122, for example, via epoxy, rivets, screws, or other suitable fastening mechanism. Further, the housing 102 may be a made of a single piece and/or of a single material type, such as metal or plastic, or be assembled from multiple pieces, such as a piece for one or more sidewalls 122 and a curved frame around the fan blades 108, and may include one or more flanges. Furthermore, the air guides 118 may be made of the same or different material as the housing 102. For example, the air guides 118 and/or housing 102 may be made of a metal, such as aluminum, steel, tin, or metal alloy or a polymer such as a plastic material.

Figure 7:
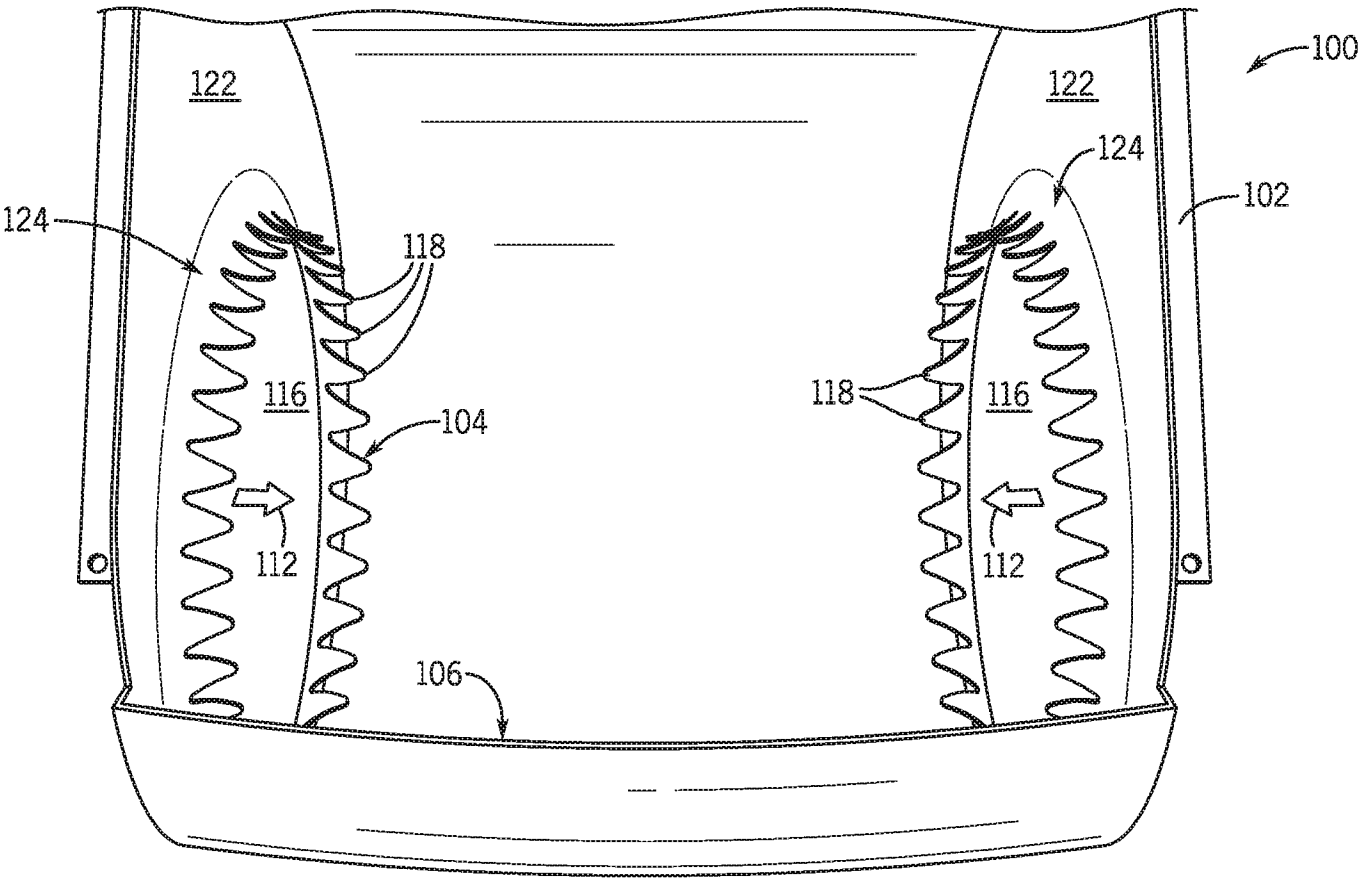
FIG. 7 is an internal view of an example of a housing of the fan assembly of FIG. 5, in accordance with an embodiment of the present disclosure.

In some embodiments, the fan assembly 34 may draw air into a second air inlet 104 on a second sidewall 122 opposite the first as illustrated in FIG. 7. FIG. 7 is an example fan assembly 100 viewed through the air outlet 106 with the blades 108 removed. In one such embodiment, the incoming air flow 112 is drawn into the housing 102 from the air inlets 104 on both sides of the fan assembly 100 and then ejected through a singular air outlet 106. As such, the air guides 118 may be implemented on both sides of the fan assembly 100 to reduce the generation of turbulence as the incoming air flow 112 is drawn through the air inlets 104.

Additionally or alternatively, the air guides 118 may be disposed at any suitable orifice facilitating air movement, such as the orifice 116 of the air inlet 104. For example, the air guides 118 may be disposed on the air inlet 104 and/or air outlet 106 of the fan assembly 100 to facilitate a reduction in turbulence in the air flow. Additionally, the air guides 118 may generally protrude in the approximate direction of the air flow. For example, at the air inlet 104, the incoming air flow 112 flows into the housing 102. Moreover, the air guides 118 may be bent into the desired orientation, formed in the desired orientation, or attached to the air inlet 104, sidewall 122, and/or the housing 102 in the desired orientation. For example, in one embodiment, the air inlet 104 and/or the air guides 118 may be integral to the sidewall 122 and bent into the body of the housing 102. As such, the air guides 118 may protrude from the air inlet 104 into the housing 102. Similarly, at an air outlet 106, the outbound air flow 114 flows out of the housing 102, and air guides 118 may be disposed around the air outlet 106 and protrude out of/away from the interior of the housing 102. By assisting in the reduction of turbulence such as eddies and/or cavitation, the air guides 118 may lead to reduced electrical draw, increased volume of air through the HVAC unit 12, and/or decreased noise associated with the flow of air.

Figure 8:
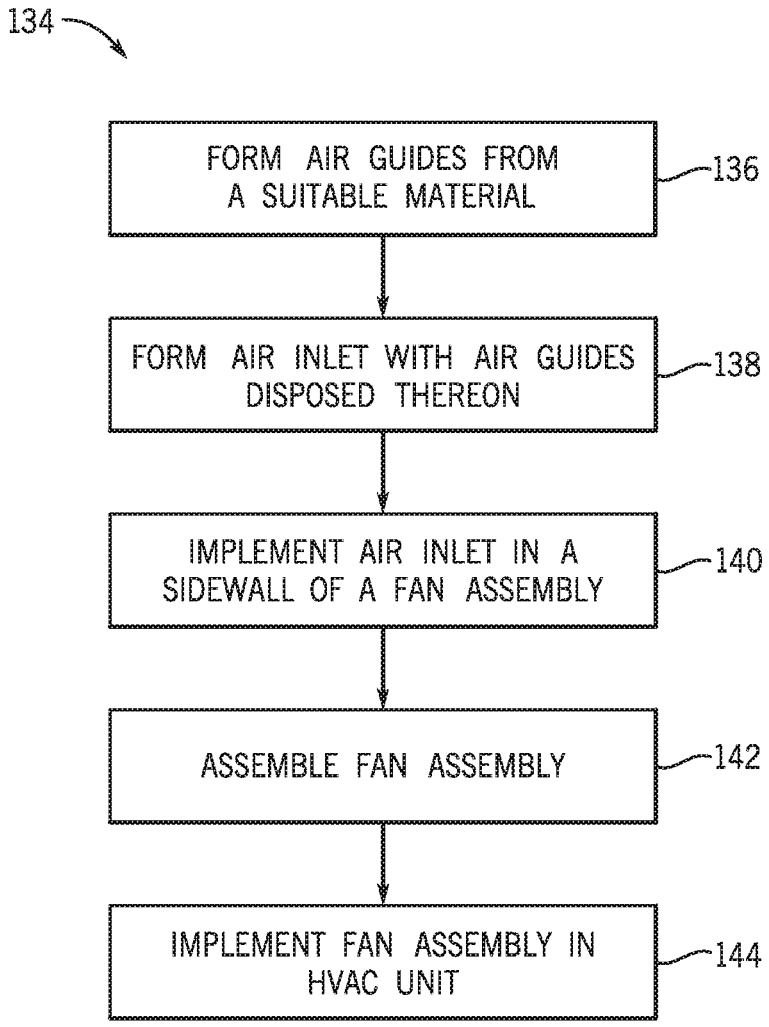
FIG. 8 is a flowchart of an example process for implementing air guides in a fan assembly, in accordance with an embodiment of the present disclosure.

FIG. 8 is a flowchart of an example process 134 of implementing air guides 118 in a fan assembly 100. In some embodiments, air guides 118 may be formed from a suitable material (process block 136), and an air inlet 104 may be formed with the air guides 118 disposed thereon (process block 138). The air inlet 104 may be implemented in a sidewall 122 of a fan assembly 100 (process block 140), and the fan assembly 100 may be assembled (process block 142) and the fan assembly 100 may be implemented in an HVAC unit 12 (process block 144).

As stated above, in some embodiments, the air guides 118 may be formed from a suitable material such as a metal or polymer. Further, the air guides 118 may be formed individually and subsequently attached to the air inlet 104, for example via an adhesive, weldment, and/or fastener, or the air guides 118 may be formed with the air inlet from a single piece or multiple pieces of material. Moreover, the air guides 118 and/or the air inlet 104 may be formed, for example, by molding, cutting, bending, pressing, and/or shearing the suitable material or any other suitable process. Additionally, the air inlet 104 and air guides 118 may be implemented on the sidewall 122 of the fan assembly 100. For example, the air inlet 104 may be formed as a separate piece from the sidewall 122 and attached thereto, for example, via adhesive, weldment, and/or fastener, or the air inlet 104 and sidewall 122 may be formed together from a single or multiple pieces of material. Assembly of the fan assembly 100 may include attaching the sidewall 122 to one or more other components of the housing 102. Furthermore, assembly may include disposing the fan blades 108 within the housing 102 and/or coupling the fan blades 108 to a motor, which, in some embodiments, may be mounted on or within the housing 102. The fan assembly 100 can then be utilized in an HVAC unit 12.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A fan assembly, comprising:

a fan comprising a plurality of blades configured to rotate about an axis;

a housing in which the fan is disposed, wherein the housing comprises a wall having a planar portion extending transverse to the axis; and an air inlet formed in the wall and defining an orifice configured to receive an air flow in a downstream direction that extends from the air inlet toward the fan, wherein the air inlet includes a plurality of air guides that each extend into an interior of the housing and extend beyond the planar portion of the wall in the downstream direction, wherein the plurality of air guides forms a perimeter of the air inlet.

2. The fan assembly of claim 1, wherein each air guide of the plurality of air guides is tooth-shaped.

3. The fan assembly of claim 1, wherein each air guide of the plurality of air guides is curved.

4. The fan assembly of claim 1, wherein the wall comprises a filleted portion extending from the planar portion, wherein the plurality of air guides is integral with the filleted portion of the wall.

5. The fan assembly of claim 1, wherein the orifice of the air inlet is substantially circular.

6. The fan assembly of claim 1, wherein:

the wall is a first wall;

the air inlet is a first air inlet;

the orifice is a first orifice; and the plurality of air guides is a first plurality of air guides, and wherein the housing includes a second wall transverse to the axis, a second air inlet formed in the second wall, and a second plurality of air guides formed around a circumference of a second orifice defined by the second air inlet, wherein the second plurality of air guides extends from the second wall into the housing toward the first wall.

7. The fan assembly of claim 1, wherein the fan assembly comprises a centrifugal blower assembly.

8. The fan assembly of claim 1, wherein the plurality of air guides extends into the interior of the housing at an angle less than ninety degrees relative to the planar portion of the wall.

9. The fan assembly of claim 1, wherein the plurality of air guides is configured to reduce formation of turbulent eddies in the air flow through the fan assembly as the air flow enters the air inlet.

10. The fan assembly of claim 1, wherein the plurality of air guides is configured to smooth separation of a boundary layer of the air flow from the wall, the air inlet, or both.

11. The fan assembly of claim 1, wherein each of the plurality of air guides includes a point radius and a trough radius, wherein the trough radius is greater than the point radius.

12. The fan assembly of claim 1, wherein the plurality of blades forms a fan cage disposed about the axis.

13. The fan assembly of claim 1, comprising a motor coupled to the plurality of blades, wherein the motor is configured to actuate the plurality of blades to draw the air flow through the air inlet and into the interior of the housing in the downstream direction, wherein the motor has an output shaft disposed along the axis and coupled to the plurality of blades.

14. The fan assembly of claim 1, wherein the fan assembly is configured to facilitate flow of the air flow across a heat exchanger of a heating, ventilation, and air conditioning (HVAC) system.

15. The fan assembly of claim 1, wherein the fan is configured to draw the air flow through the air inlet in the downstream direction, wherein respective vertices of the plurality of air guides are disposed downstream of the planar portion of the wall with respect to flow of the air flow through the air inlet.

16. The fan assembly of claim 1, wherein the wall comprises a filleted portion that extends tangentially from the planar portion, wherein the plurality of air guides is formed in the filleted portion.

17. A fan housing, comprising:

a first wall having a first planar portion;

a second wall having a second planar portion;

a third wall extending between and along the first wall and the second wall to define an interior of the fan housing extending between the first planar portion and the second planar portion, wherein the interior houses a plurality of fan blades;

an air inlet configured to guide ingress of an air flow in a downstream direction into the interior and toward the plurality of fan blades;

an air outlet configured to guide egress of the air flow away from the interior; and a plurality of air guides formed in the first wall and curving inward toward and into the interior of the fan housing, wherein the first planar portion of the first wall is upstream of respective vertices of the plurality of air guides with respect to a flow of the air flow in the downstream direction, wherein the plurality of air guides is disposed about the air inlet, and wherein each of the plurality of air guides is a tooth-shaped protrusion.

18. The fan housing of claim 17, wherein the plurality of air guides surrounds the air inlet.

19. The fan housing of claim 17, wherein each of the plurality of air guides protrude less than 1 inch from the first planar portion.

20. The fan housing of claim 17, wherein the plurality of fan blades is configured to rotate about an axis to draw the air flow into the air inlet in the downstream direction, wherein at least one tooth-shaped protrusion of the plurality of air guides includes a vertex positioned downstream of the first planar portion with respect to flow of the air flow in the downstream direction.

21. A heating, ventilation, and air conditioning (HVAC) system, comprising:

ductwork configured to transport an air flow; and a centrifugal blower assembly comprising a housing, a motor, and a plurality of blades forming a cage within the housing, wherein the motor is configured to rotate the cage about an axis to draw the air flow through an air inlet of the housing and toward the plurality of blades in a downstream direction, and to force the air flow out an air outlet of the housing, wherein the housing comprises a wall having a planar surface extending transverse to the axis, wherein the air inlet has a plurality of tooth-shaped air guides disposed about a perimeter of the air inlet, and wherein the plurality of tooth-shaped air guides is within an interior of the housing and downstream of the planar surface relative to a flow of the air flow in the downstream direction.

22. The HVAC system of claim 21, wherein the plurality of tooth-shaped air guides is affixed to the housing via epoxy, a rivet, a screw, or a combination thereof.

23. The HVAC system of claim 21, wherein the air inlet comprises an orifice formed in the wall of the housing, wherein the wall extends perpendicular to the downstream direction, and wherein the plurality of tooth-shaped air guides is angled to extend into the housing at an angle between 30 degrees and 90 degrees from the wall.

24. The HVAC system of claim 21, wherein the wall is a first sidewall, the housing includes a second sidewall, wherein the air inlet is disposed on the first sidewall, and a second air inlet having a second plurality of tooth-shaped air guides is disposed on the second sidewall.

25. The HVAC system of claim 21, comprising a heat exchanger configured to condition the air flow.

26. The HVAC system of claim 25, wherein the heat exchanger is an evaporator coil.

* * * * *